United States Patent [19]

Lavery

[11] 4,361,236

[45] Nov. 30, 1982

[54] CARTON FOR MAILING AND STORAGE OF CHECKS

[75] Inventor: John J. Lavery, Chicago, Ill.

[73] Assignee: Champion International Corporation, Stamford, Conn.

[21] Appl. No.: 231,385

[22] Filed: Feb. 4, 1981

[51] Int. Cl.[3] ..... B65D 5/54

[52] U.S. Cl. ..... 206/611; 206/625; 229/31 FS

[58] Field of Search ..... 206/625, 611, 612, 624; 229/31 FS, 34 R

[56] References Cited

U.S. PATENT DOCUMENTS

| | | | |
|---|---|---|---|
| 2,214,813 | 9/1940 | Guyer | 229/31 FS |
| 2,220,076 | 11/1940 | Carruth | 229/34 R |
| 2,768,776 | 10/1956 | Weiss | 229/31 FS |
| 3,195,800 | 7/1965 | Cote | 206/611 |
| 3,240,419 | 3/1966 | Spiering et al. | 206/625 |
| 3,638,853 | 2/1972 | Perry | 206/611 |
| 3,987,957 | 10/1976 | Johhnson | 229/31 FS |
| 4,245,743 | 1/1981 | Heuberger | 206/611 |
| 4,306,658 | 12/1981 | Montealegre | 206/611 |

FOREIGN PATENT DOCUMENTS

| | | | |
|---|---|---|---|
| 1027588 | 4/1958 | Fed. Rep. of Germany | 229/31 FS |
| 2114034 | 6/1972 | France | 229/31 FS |
| 2232486 | 1/1975 | France | 229/34 R |

*Primary Examiner*—Stephen P. Garbe

*Attorney, Agent, or Firm*—Evelyn M. Sommer

[57] ABSTRACT

A one-piece carton construction used to mail and store checks includes a double front, bottom, back and top wall. A double side wall construction is hingedly connected to the front and rear walls by web corners adapted to be folded along a diagonal. Each side wall construction also has a tab which is frictionally locked against the bottom wall of the carton between the front and back walls to retain the double wall side walls and front, rear and bottom wall panels in a substantially rectangular parallelopiped configuration. Checks are placed within the rectangular parallelopiped enclosure and the top wall is folded downwardly about the back wall to form a cover for the carton. The top wall has a tuck flap hingedly connected to its front edge and a pair of rupturable panels connected to opposed side edges of the top wall. Each rupturable panel includes a tear strip bounded by cut score lines and a terminal adhesive panel. A hot melt adhesive is applied to the inner surface of each of the adhesive panels and each adhesive panel is adhered to the adjacent side wall to seal the carton and preclude unauthorized opening. When the carton is received by the consumer, the tear strips, are removed so that the carton can be opened and the checks removed. To reclose, it is only necessary to place the tuck flap within the interior of the carton adjacent the front wall.

3 Claims, 15 Drawing Figures

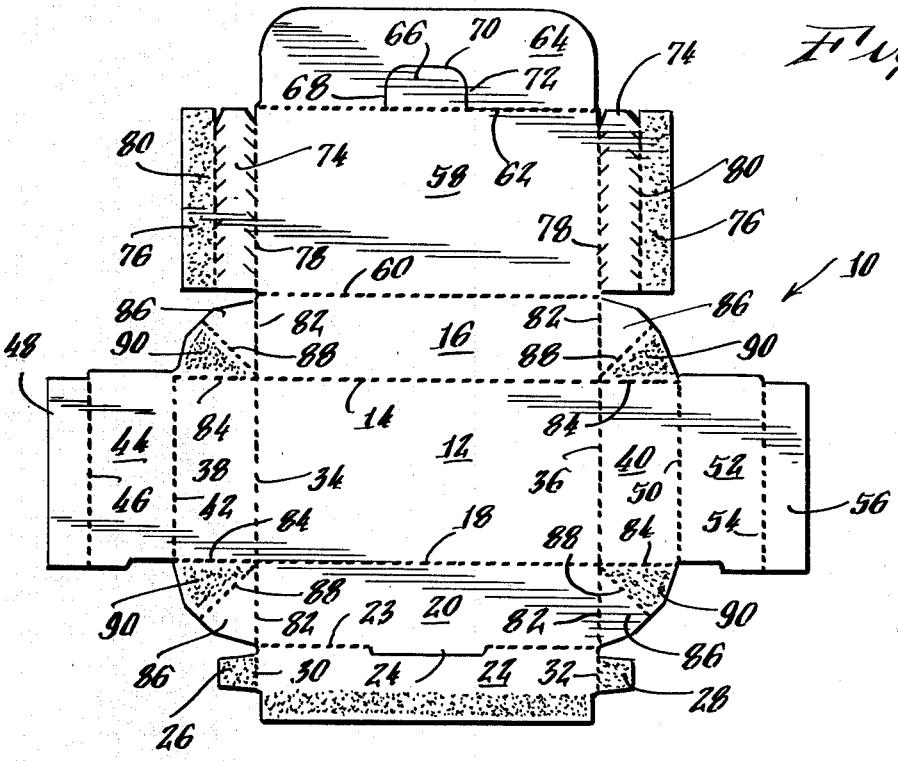
Fig. 1.
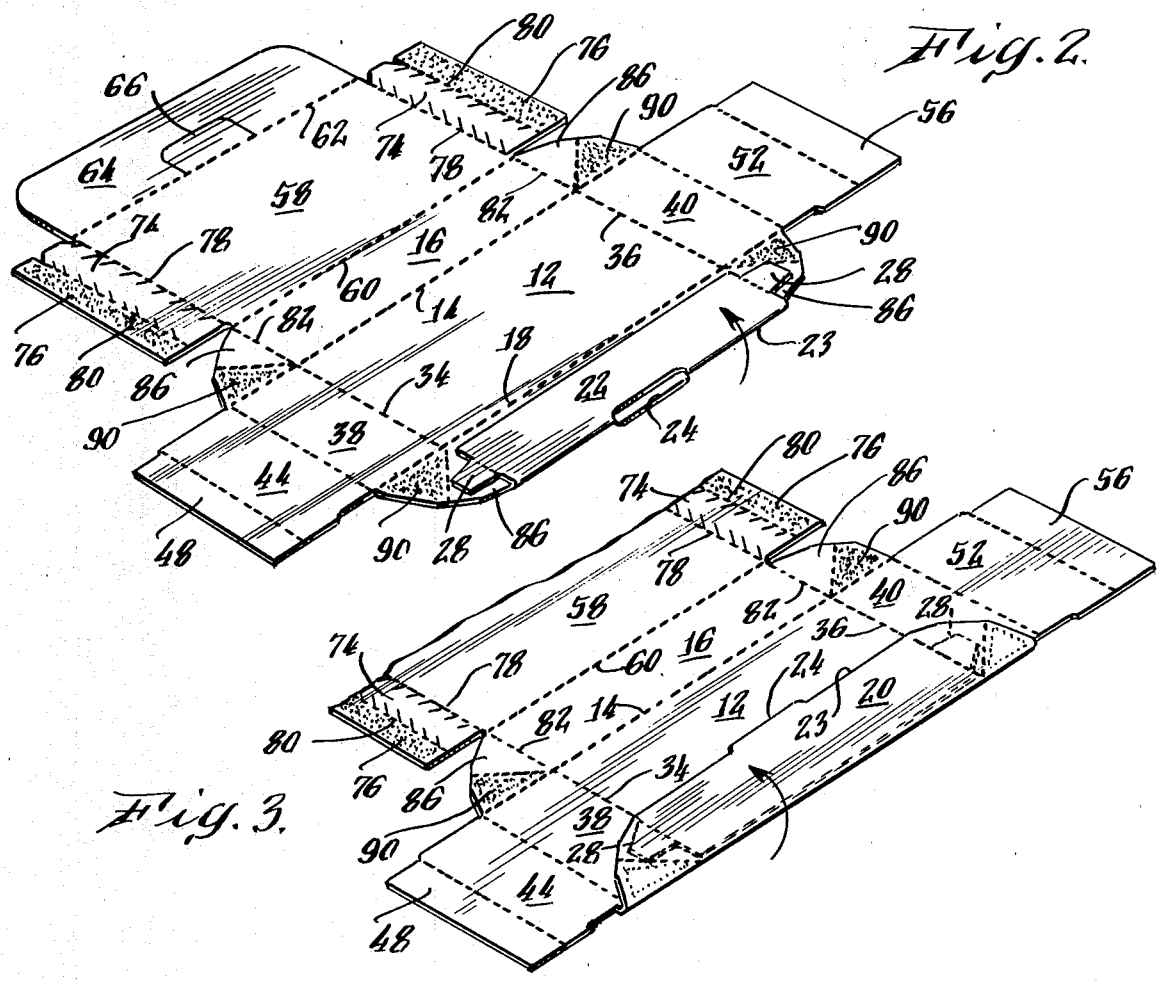
Fig. 2.
Fig. 3.

CARTON FOR MAILING AND STORAGE OF CHECKS

BACKGROUND OF THE INVENTION

This invention relates to a carton construction, and more particularly, a one-piece construction which can be used to mail and store rectangular paper items such as checks.

Heretofore, such cartons were made from two rectangular parallelopiped, mating pieces. The bottom portion contained the checks and a top portion, separate from the bottom portion, was utilized as a cover. The top portion has front, rear and side walls which were slid downwardly along the front, rear and side walls of the bottom portion. In order to mail the carton and preclude unauthorized tampering, it was necessary to wrap the same with a thermoplastic material which had portions adhesively bonded to itself so that the top and bottom portions could not separate.

The one-piece construction of the present invention eliminates the need of an outer carton wrapper or outer mailer; two separate pieces of paperboard which have a different blank construction; and reduces inventory control problems associated with the use of three different pieces of material.

SUMMARY OF THE INVENTION

In accordance with the present invention, the carton has a one-piece construction which includes a double front wall, and bottom, back and top walls. A double side wall construction is hingedly connected to the front and back walls by web corners adapted to be folded along a diagonal. The half of the web corners between the diagonal and an adjacent first side wall panels which are hingedly connected to the bottom wall, is glued to the first side wall panels. Because the web corners are glued, when the first side wall panels are folded to an erect, upright position relative to the bottom wall, the previously formed, double front wall and the rear wall are automatically folded and assume an upright condition at the same time. A second side wall panel connected to each of the first side wall panels glued to the web corners are then folded 180° over the web corners into parallel relation with the associated first side wall panel. Each of the second side wall panels has a tab which is frictionally locked against the bottom wall of the carton between the front and back walls to retain the double wall side wall panels, the double front, wall and the rear and bottom wall panels in a substantially rectangular parallelopiped configuration.

After checks are placed within the rectangular parallelopiped enclosure, the top wall is folded downwardly about the back wall to form a cover for the carton. The top wall has a tuck flap hingedly connected to its front edge which tuck flap is inserted within the interior of the carton to lock the top wall to the carton. A front stabilizer lock tab is die cut from the top panel and is inserted within an opening or slot formed in the front wall of the carton, between a pair of parallel, front wall panels.

Connected to opposite edges of the top wall (or cover panel) are a pair of rupturable panels. Each of the rupturable panels includes a tear strip bounded by parallel cut score lines and a terminal adhesive panel. Prior to the carton being mailed to the consumer, the rupturable panels are folded down and a hot-melt adhesive is applied along the adhesive panels on each of the rupturable panels to seal the carton and preclude unauthorized opening.

When the carton is received by the consumer, the tear strips, not adhesively connected to the side wall panels by the hot-melt adhesive, are removed so that the carton can be opened and the checks removed. To reclose, it is only necessary to place the tuck flap within the interior of the carton adjacent the front wall with the front tab lock engaged in the slot between the front wall panels of the double front wall construction.

BRIEF DESCRIPTION OF THE DRAWINGS

Further objects and advantages of the invention will become apparent from the following description and claims, and from the accompanying drawings, wherein:

FIG. 1 is a plan view of a blank for forming the carton of the present invention;

FIGS. 2 to 4, inclusive, and FIGS. 6 to 8, inclusive, are perspective views illustrating the manner of folding the blank of FIG. 1 to form the carton of the present invention;

DETAILED DESCRIPTION OF THE PREFERRED EMBODIMENT

Figure 4:
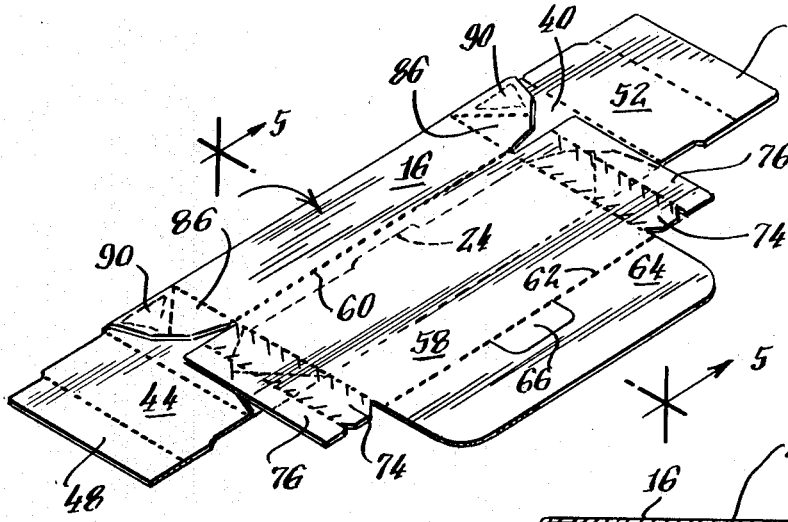
Figure 5:
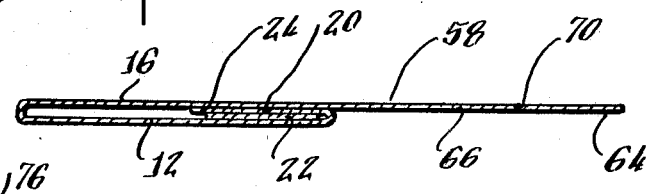
FIG. 5 is a cross-sectional view of a partially folded blank taken substantially along the plane indicated by line 5—5 of FIG. 4.
Figure 6:
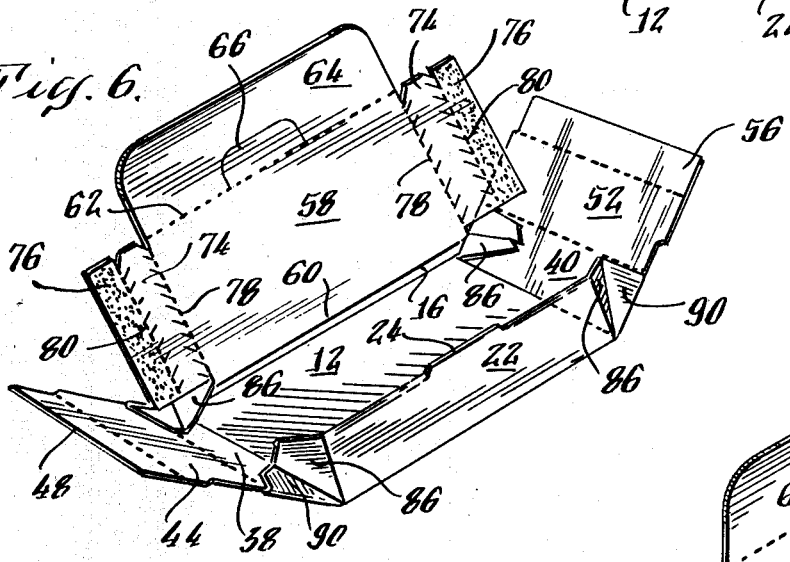
Figure 7:
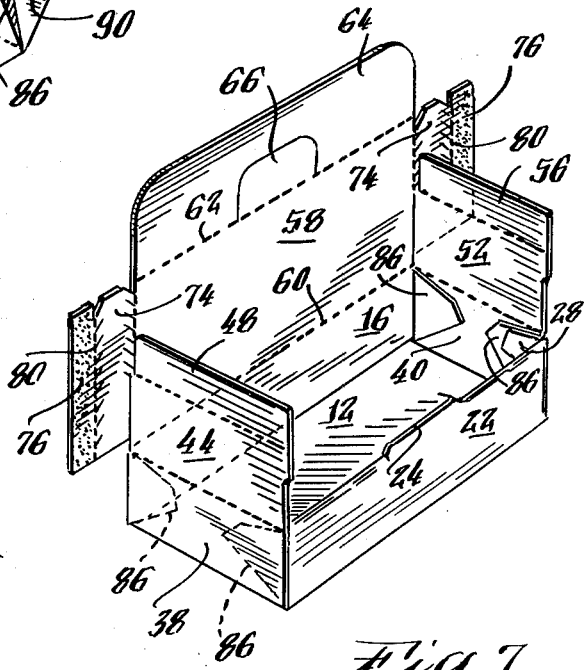
Figure 8:
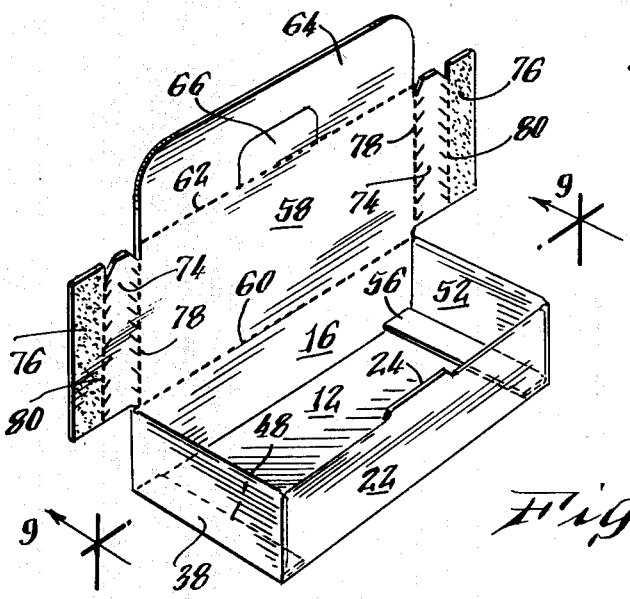
Figure 9:
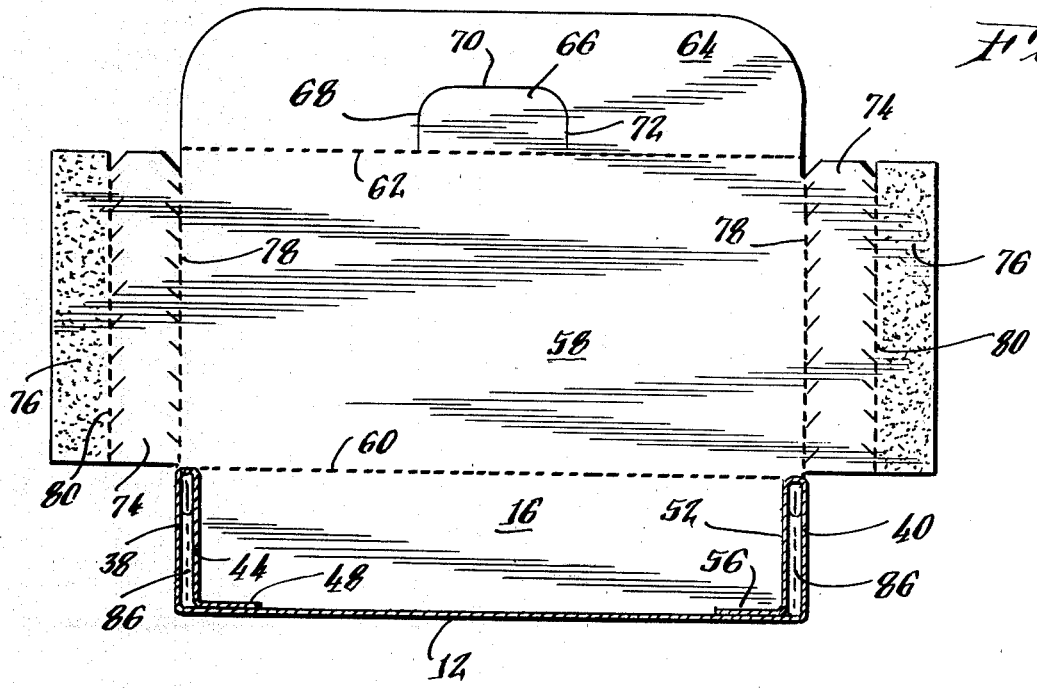
FIG. 9 is a cross-sectional view of a partially folded blank taken substantially along the plane indicated by line 9—9 of FIG. 8.
Figure 10:
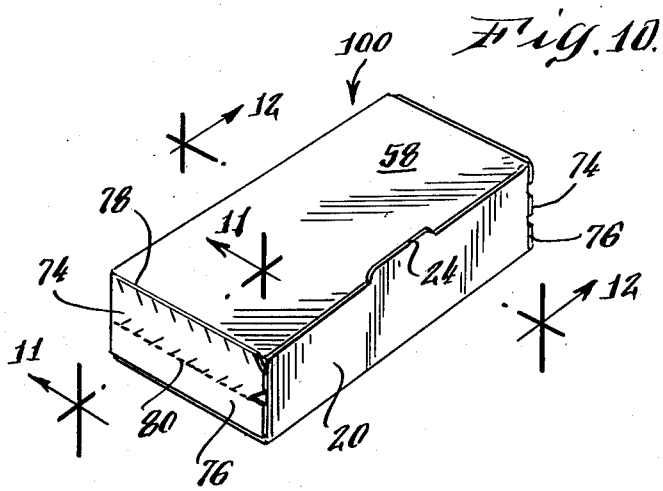
FIG. 10 is a perspective view of the constructed carton of the present invention.
Figure 11:
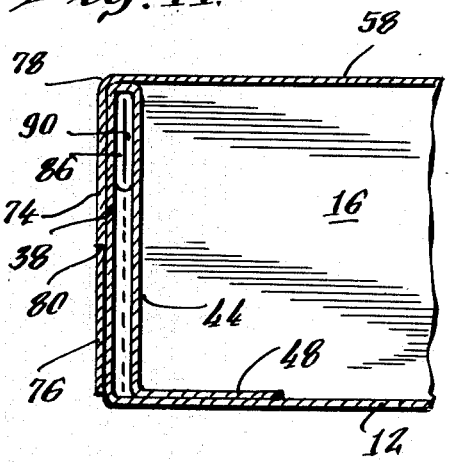
FIG. 11 is a cross-sectional view taken substantially along the plane indicated by line 11—11 of FIG. 10.

Referring now to the drawings in detail, wherein like numerals indicate like elements throughout the several views, the blank 10 for forming the carton of the present invention is illustrated in FIG. 1.

The blank 10 comprises a bottom wall, substantially rectangular panel 12 foldably connected by a score line 14 to a rear or back wall panel 16 which is also substantially rectangular in shape. Foldably connected to the opposed edge of the bottom wall panel by a score line 18 is the first of two front wall panels. The first front wall panel 20 connected to score line 18 is connected to a second front wall panel 22 by a score line 23. A pair of side tabs 26 and 28 are foldably connected along score lines 30 and 32, respectively, to opposed edges of the second front wall panel 22.

Foldably connected to opposed side edges of the bottom wall panel 12 by score lines 34 and 36, respectively, are first side wall panels 38 and 40. The first side wall panel 38 is connected by a score line 42 to a second side wall panel 44, which is in turn connected by score line 46 to a friction tab 48, whose function will be described in more detail hereinafter. Similarly, the first side wall panel 40 is connected by a score line 50 to a second side wall panel 52, which in turn is connected by a score line 54 to a friction tab 56.

A top wall panel 58 is connected by a score line 60 to the top edge of rear or back wall panel 16. The top edge of the top wall panel 58 is connected by a score line 62 to a tuck flap 64. A substantially rectangular front lock stabilizer panel 66 is cut along three edges 68, 70 and 72 commencing from score line 62 and terminating at score line 62 so that the front lock stabilizer panel can be pushed inwardly or out of the plane of the tuck flap 64. Connected to opposed lateral edges of the top wall panel 58 are first and second rupturable panels each of which includes a tear strip 74 and a terminal adhesive panel 76. The tear strips 74 are connected to opposed edges of the top wall panel 58 by a line of rupture or a tear line 78 while the tear strips 74 and 76 adhesive panels are connected by a second line of rupture or a tear line 80.

Foldably connected by vertical score lines 82 and horizontal score lines 84 between the top and bottom edges of the first side wall panels 38 and 40, respectively, and the side edges of the first front and rear panels 20 and 16, respectively, is a web corner 86. Each of the web corner panels 86 includes a diagonal score line 88 which substantially bisects the panel along a diagonal.

As shown in FIG. 2, in order to form the carton 100 of the present invention, the second front wall panel 22 is folded about score line 23 over first front wall panel 20 and adhesively adhered thereto. Cut in panel 22, having an uncut base on score line 23 is a tab 24, so that when panel 22 is folded to overlie panel 20, an opening into the space between the panels is formed adjacent tab 24.

As further shown in FIGS. 2–5, the blank is then folded about score lines 18 and 14 and the half 90 of the web corner panels 86 adjacent the first and second side wall panels is adhesively connected to the adjacent portions of the first side wall panels 38 and 40, respectively. In this configuration, the carton can be shipped to a prospective user, such as a bank or a bank note printer for final erection prior to shipment to a consumer.

As illustrated in FIGS. 6 to 9, inclusive, in order to completely erect a carton 100, it is only necessary to pivot and raise the first side wall panels 38 and 40 to an upright condition about their respective score lines 34 and 36. This will automatically cause the double front wall panel 20, 22 and rear wall panel 26 to assume an upright condition by pivoting about their score lines 18 and 14, respectively, relative to the bottom wall panel 12, as the web corner panel 86 will be folded in half about its respective diagonal 88. The second side wall panel 44 and 52 is then rotated 180° back upon itself about its respective score lines 42 and 50 to overlie the first panels 38 and 40 to form a double side wall construction. Each of the web corner panels are disposed between the pairs of first and second side wall panels 38, 44 and 40, 52. The double side wall panel constructions are then locked in place by positioning the friction tabs 48 and 56 between the front, double wall construction consisting of panels 20 and 22 and the rear wall 16 by bending the flange 48 and 56 about score lines 46 and 54, respectively, into seated engagement with the bottom wall panel 12.

Figure 12:
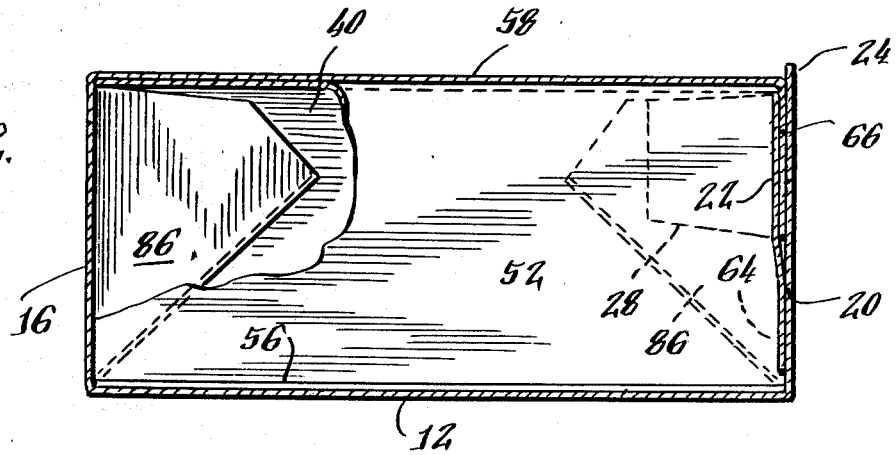
FIG. 12 is a cross-sectional view taken substantially along the plane indicated by line 12—12 of FIG. 10.

The checks to be mailed can then be placed within the interior of the carton 100; particularly in the space defined by the front, side and back or rear walls which are in the form of a rectangular parallelopiped. The top wall panel 58 is then folded downwardly about the score line 60 to form a cover for the carton. The tuck flap 64 is inserted within the interior of the carton in parallel adjacent relation to the double front wall panels 20 and 22. The front stabilizer lock panel 66, which is die cut from the tuck panel 64 about lines 68, 70 and 72 is engaged in the slot formed adjacent tab 24 between the double walled front panels 20 and 22, as shown in FIG. 12.

The rupturable panels extending from opposite sides of the top wall panel 58 are then folded downwardly into abutment and parallel relation with the double side wall panel constructions 38, 44 and 40, 52. The adhesive panels 76 are adhesively connected by hot-melt adhesive to the outermost one 38 and 40, respectively, of the double side wall panels of the carton 100.

Figure 13:
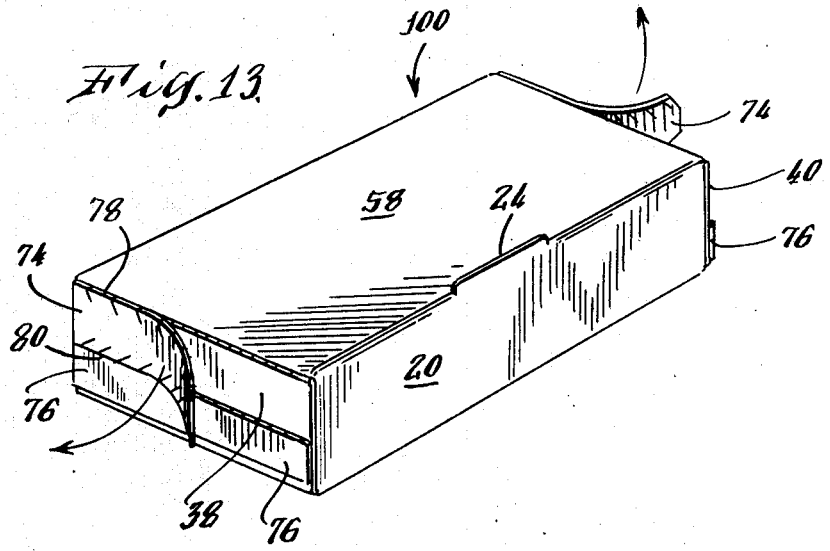
FIGS. 13 to 15, inclusive, are perspective views illustrating the manner of opening and reclosing the carton of FIG. 10, after it has been initially sealed and mailed to a consumer.
Figure 14:
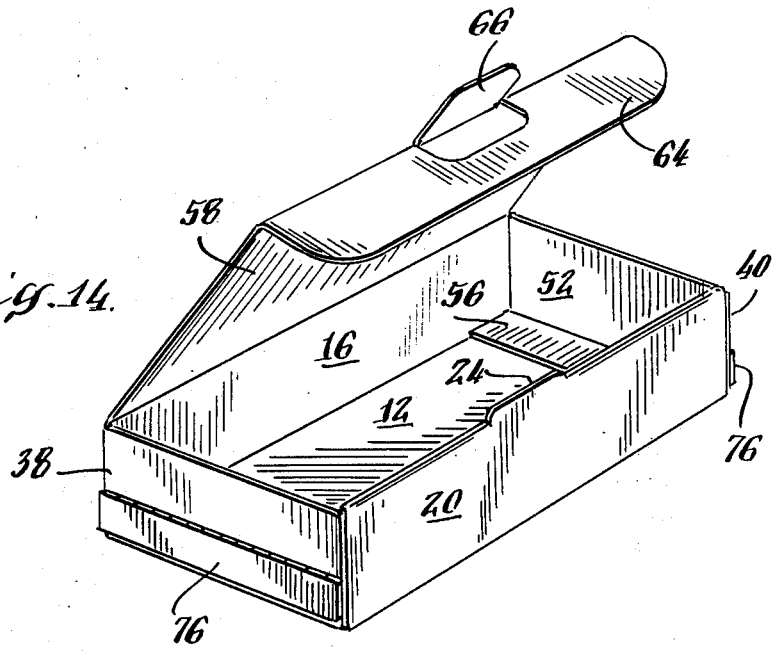
Figure 15:
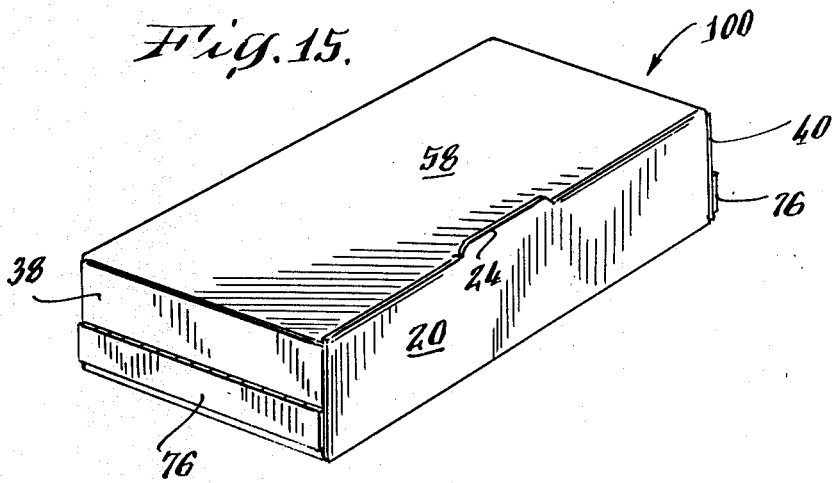

The carton 100 can then be mailed to a consumer. Upon receipt, as illustrated in FIGS. 13 to 15, inclusive, the tear strips 74 may be torn between the rupture lines 78 and 80 and the top wall panel 58 opened so that the checks from the interior of carton 100 can be removed. To reclose the carton 100, it is only necessary to reinsert the tuck panel 64 within the interior of the carton 100 adjacent to the front wall panel 22 with the front stabilizer tab lock 66 inserted into slot adjacent tab 24.

What is claimed as new is:

1. A carton for mailing and storage of checks comprising:

a front wall, a rear wall, a bottom wall connecting said front and rear walls, and means forming side walls extending between said front and rear walls, a web corner panel having a diagonal score line substantially bisecting said panel between each of said side walls and said rear and front walls, means adhesively connecting the bisected portion of each of said web corner panels adjacent to the said side wall to said side wall, means connected to each of said side walls for locking said side walls, front, rear and bottom walls in a rectangular parallelopiped configuration, a top wall adapted to overlie said bottom wall in a substantially parallel relation thereto foldably connected to one of said front and rear walls, said top wall including a tuck flap for insertion adjacent said front wall between said opposed side walls, and means for connecting said top wall to said side walls, said means including rupturable panels connected to opposed side edges of said top wall and adapted to be adhesively connected to opposed side walls of said carton, each of said rupturable panels including a tear strip bounded by a pair of rupture lines, and a terminal adhesive panel connected to said tear strip by one of said rupture lines, said adhesive panel being secured to the side wall adjacent thereto;

said front wall including a pair of overlapped panels having an accessible space therebetween, and a front lock stabilizing panel cut in said tuck flap received in said accessible space between said overlapped panels.

2. The carton of claim 1 wherein said accessible space between said overlapped panels has an opening thereto formed by a tab cut in one of said overlapped panels, said tab having a base colinear with a fold line between said overlapped panels.

3. A blank for forming a carton, said blank comprising:

(a) a bottom wall panel;

(b) a first front wall panel foldably connected to said bottom wall panel along a front edge thereof;

(c) a second front wall panel foldably connected to said first front wall panel along a fold line, said fold line having a tab cut in a medial portion thereof;

(d) a pair of first side wall panels, one of each being foldably connected to opposite side edges of said bottom wall panel;

(e) a pair of second side wall panels, one of each being foldably connected to each of said first side wall panels;

(f) a back wall panel foldably connected to a back edge of said bottom wall panel;

(g) a plurality of web panels foldably connected to adjacent side edges of said back wall panel and said first side wall panels, and to adjacent side edges of said first front wall panel and said first side wall panels, each of said web panels being substantially bisected by a diagonal fold line;

(h) a top wall panel foldably connected to a top edge of said back wall panel;

(i) a pair of rupturable panels one of each being foldably connected to side edges of said top wall panel, each of said rupturable panels including an intermediate tear strip bounded by a pair of rupturable cut score lines, and a terminal adhesive panel connected to said tear strip by one of said cut score lines; and (j) a tuck flap foldably connected to said top wall panel, said tuck flap having a stabilizing tab cut therefrom, said stabilizing tab being foldably connected to said top wall panel.

* * * * *